US008303474B2

(12) United States Patent
Iliev et al.

(10) Patent No.: US 8,303,474 B2
(45) Date of Patent: Nov. 6, 2012

(54) APPARATUS AND METHOD FOR INSERTION OF CAPSULES INTO FILTER TOWS

(75) Inventors: Plamen Iliev, Plovdiv (BG); Bogdan Nikolov, Plovdiv (BG); Atanas Karaatanasov, Plovdiv (BG); Valentin Iliev, Plovdiv (BG); Dimitar Yanchev, Plovdiv (BG)

(73) Assignee: Aiger Group AG, Zug (CH)

( * ) Notice: Subject to any disclaimer, the term of this patent is extended or adjusted under 35 U.S.C. 154(b) by 504 days.

(21) Appl. No.: 12/550,465

(22) Filed: Aug. 31, 2009

(65) Prior Publication Data

US 2011/0053745 A1 Mar. 3, 2011

(51) Int. Cl.
*B31C 99/00* (2009.01)

(52) U.S. Cl. ..... 493/47; 493/49; 493/50

(58) Field of Classification Search ..... 493/47, 493/49, 50; 131/202
See application file for complete search history.

(56) References Cited

U.S. PATENT DOCUMENTS

| | | | | |
|---|---|---|---|---|
| 3,550,750 | A | 12/1970 | Jackson | |
| 4,191,294 | A * | 3/1980 | McGrath et al. | 209/135 |
| 4,402,349 | A * | 9/1983 | Engert et al. | 141/9 |
| 4,541,825 | A * | 9/1985 | Hyde et al. | 493/44 |
| 4,593,706 | A * | 6/1986 | Preston et al. | 131/109.1 |
| 4,723,559 | A | 2/1988 | Labbe | |
| 4,862,905 | A | 9/1989 | Green et al. | |
| 5,221,512 | A * | 6/1993 | Sancinelli | 266/80 |
| 5,542,901 | A | 8/1996 | Atwell et al. | |
| 6,723,033 | B1 | 4/2004 | Scott et al. | |
| 7,093,625 | B2 | 8/2006 | Smith et al. | |
| 7,381,175 | B2 | 6/2008 | Dawson et al. | |
| 2005/0070409 | A1 | 3/2005 | Deal | |
| 2006/0157070 | A1 | 7/2006 | Belcastro et al. | |
| 2006/0293157 | A1 * | 12/2006 | Deal | 493/49 |
| 2007/0068540 | A1 | 3/2007 | Thomas et al. | |
| 2009/0039102 | A1 | 2/2009 | Garthaffner et al. | |
| 2009/0145449 | A1 | 6/2009 | Cieslikowski et al. | |

FOREIGN PATENT DOCUMENTS

WO 2009/071272 A1 6/2009

* cited by examiner

*Primary Examiner* — Thanh Truong

(74) *Attorney, Agent, or Firm* — Maier & Maier PLLC

(57) ABSTRACT

An apparatus for insertion of capsules into cigarette filter tows is disclosed. The apparatus may include a tow processing unit, a capsule insertion unit and a filter rod making unit. The capsule insertion unit may include a hopper, a belt, an inlet pipe, a capsule feeder wheel and a capsule insertion wheel.

7 Claims, 5 Drawing Sheets

APPARATUS AND METHOD FOR INSERTION OF CAPSULES INTO FILTER TOWS

BACKGROUND

Cigarettes and other smoking articles commonly include filter portions (universally known as filter segments) intended to remove some impurities and toxins from the cigarette smoke as it is inhaled. In certain cases, cigarette manufacturers may wish to impart flavor to the cigarette smoke as it is inhaled by the smoker.

One method of imparting flavor to a cigarette may be to include a flavor capsule within the filter portion of a cigarette. When the capsule is ruptured, it releases flavorings or aromatic material into the air stream passing through the filter. These capsules may also alter other characteristics of the inhaled smoke, such as, for example, cooling or moistening the smoke such that the smoker is provided with an enhanced smoking experience.

SUMMARY

An apparatus for insertion of capsules into cigarette filter tows, including a tow processing unit coupled to a capsule insertion unit and a filter rod making unit coupled to the capsule insertion unit, the tow processing unit including a tow bale, a plurality of rollers, a plurality of banding jets and a plasticizer chamber, and the rod making unit including a garniture bed, a sensor and a knife carrier. The capsule insertion unit including a hopper, an endless belt disposed between the hopper and an inlet pipe, a capsule feeder wheel rotating about a first axis of rotation, the feeder wheel including inner cavity in communication with said inlet pipe, a capsule insertion wheel in operative communication with the feeder wheel and rotating about a second axis of rotation, and a tow gathering funnel configured to receive an edge of the insertion wheel.

The capsule feeder wheel includes a plurality of radial grooves in communication with the inner cavity of the wheel, each groove configured to receive a plurality of capsules and terminating at an aperture at a circumferential edge of the feeder wheel; a plurality of pins, each pin corresponding to a radial groove, and disposed such that a tip of each pin may be received within a corresponding radial groove; and a stationary cam wheel configured to actuate the pins at desired points along the circumference of the cam wheel.

The capsule insertion wheel includes a plurality of recesses defined along a circumferential edge of the insertion wheel, each recess configured to receive a capsule; a plurality of pins, each pin corresponding to a recess, and disposed such that a tip of each pin may be received within a corresponding recess; and a stationary cam wheel configured to actuate the pins at desired points along the circumference of the cam wheel.

DETAILED DESCRIPTION

Aspects of the invention are disclosed in the following description and related drawings directed to specific embodiments of the invention. Alternate embodiments may be devised without departing from the spirit or the scope of the invention. Additionally, well-known elements of exemplary embodiments of the invention will not be described in detail or will be omitted so as not to obscure the relevant details of the invention. Further, to facilitate an understanding of the description discussion of several terms used herein follows.

As used herein, the word "exemplary" means "serving as an example, instance or illustration." The embodiments described herein are not limiting, but rather are exemplary only. It should be understood that the described embodiment are not necessarily to be construed as preferred or advantageous over other embodiments. Moreover, the terms "embodiments of the invention", "embodiments" or "invention" do not require that all embodiments of the invention include the discussed feature, advantage or mode of operation.

Figure 1:
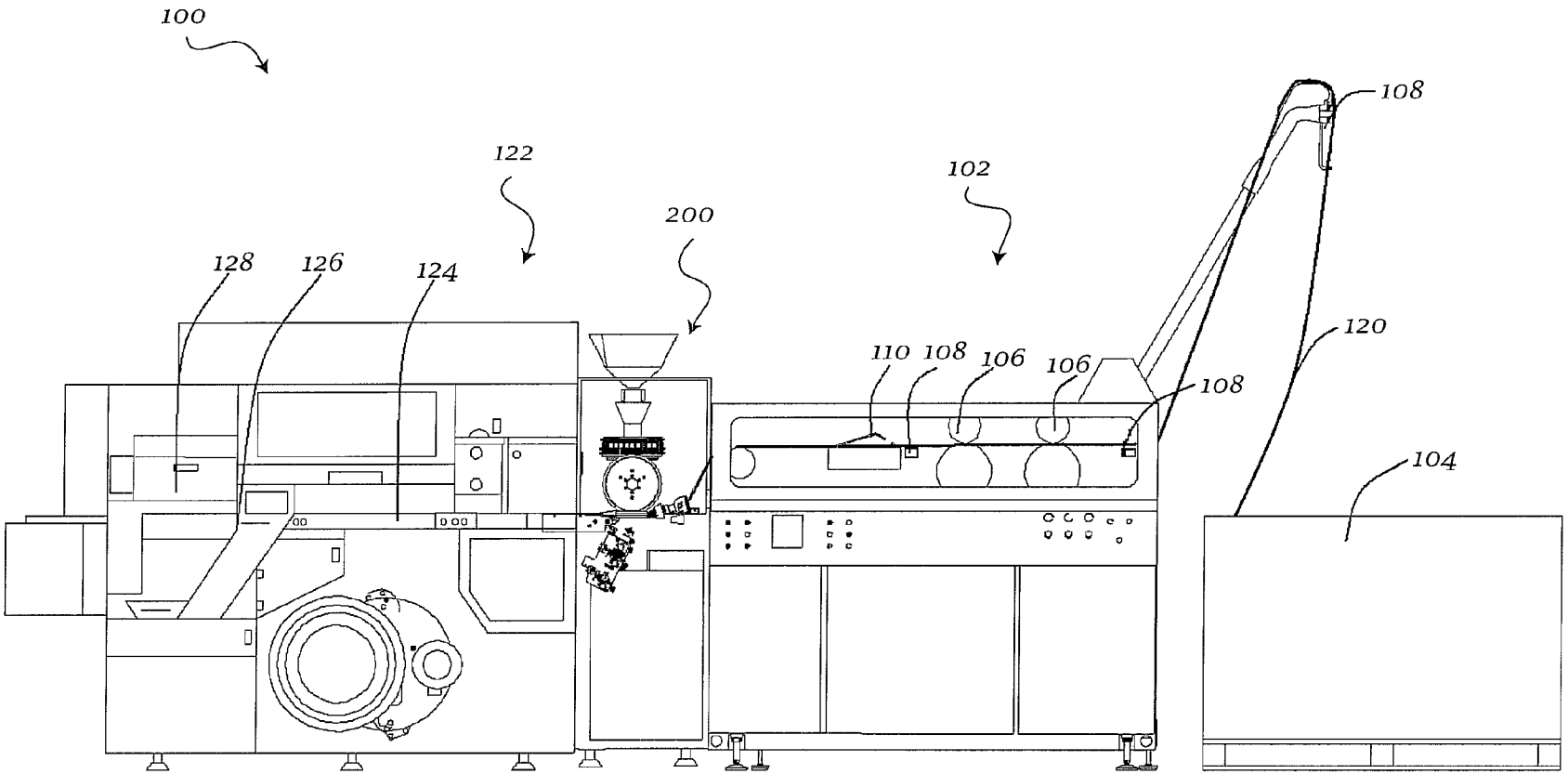
FIG. 1 is an exemplary diagram of an apparatus for insertion of capsules into filter tows.

Turning to FIG. 1, an apparatus for inserting capsules into filter webs 100 is provided. Apparatus 100 may include a tow processor unit 102, a capsule insertion unit 200 and a rod making unit 122. Tow processor unit 102 may include a bale 104, a plurality of rollers 106, a plurality of banding jets 108 and plasticizer chamber 110. Rod making unit 122 may include a garniture bed 124, sensor 126 and knife carrier 128. Filter tow 120 may be withdrawn from bale 104, and directed towards rollers 106 and banding jets 108, which facilitate the expansion and blooming of tow 120 to a desired width. After passing over rollers 106 and banding jets 108, tow 120 may be directed to plasticizer chamber 110, where it may be coated with plasticizer, which facilitates the swelling of the fibers of tow 120 and imparts greater cohesive properties to tow 120. Upon exiting plasticizer chamber 110, tow 120 may be directed towards capsule insertion unit 200.

Figure 2:
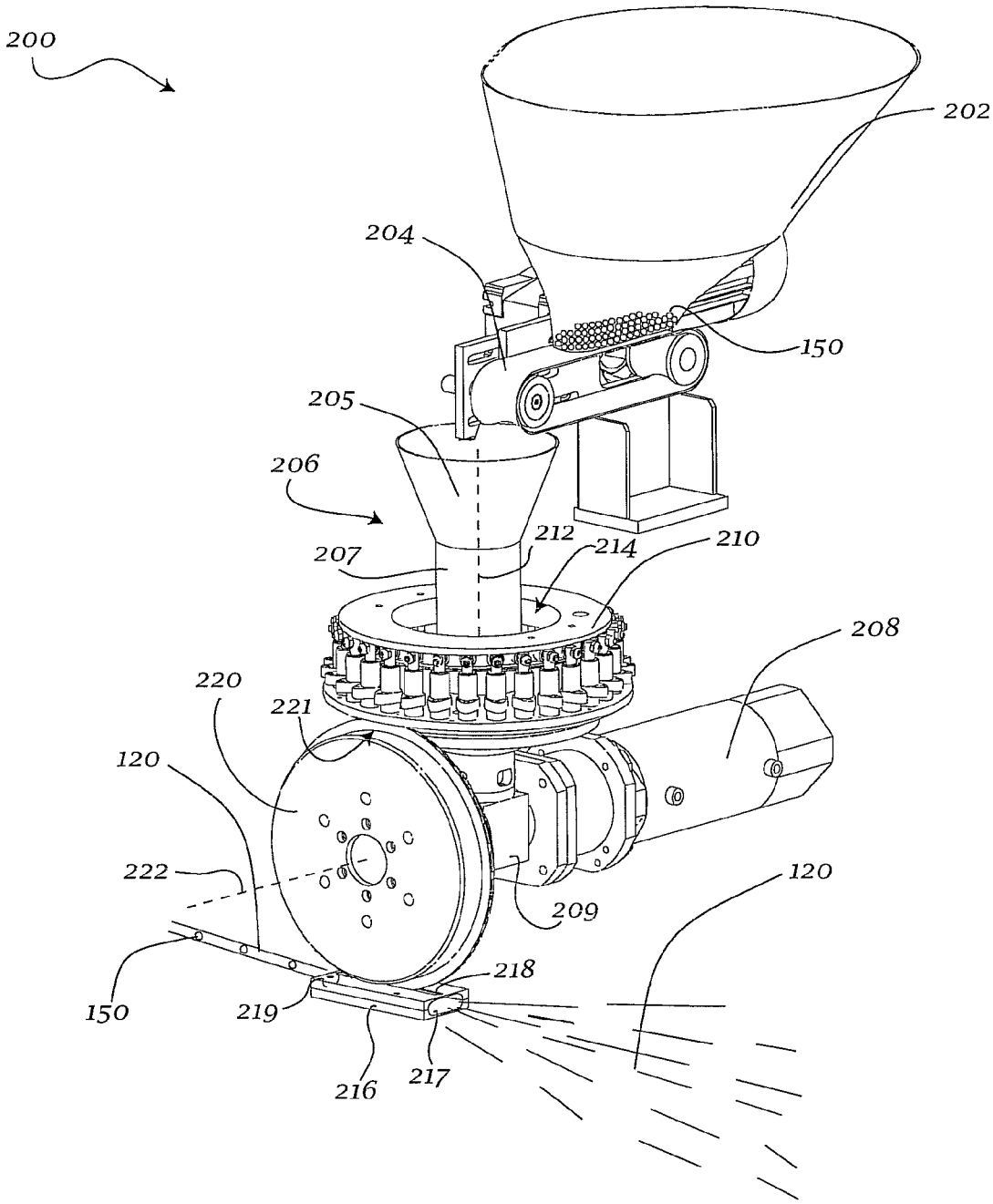
FIG. 2 is a view of an exemplary embodiment of a capsule insertion unit.

Turning now to FIG. 2, capsule insertion unit 200 may include a hopper 202, endless belt 204, inlet pipe 206, feeder wheel 210, motor 208, and insertion wheel 220. Hopper 202 may have an opening defined near the bottom thereof. Endless belt 204 may be positioned in close proximity to the bottom opening of hopper 202 and have an end positioned substantially near inlet pipe 206 such that capsules 150 may be collected in hopper 202 and transferred to inlet pipe 206 via endless belt 204. Inlet pipe 206 may have a top portion 205 positioned to collect capsules 150 from endless belt 204. In one embodiment, top portion 205 may optionally be substantially conical. Alternatively, top portion 205 may have a shape known to one of ordinary skill in the art. Inlet pipe 206 may also have a bottom portion 207 substantially coaxial to and in communication with a circular cavity 214 defined in feeder wheel 210. Circular cavity 214 may be defined such that cavity 214 is concentric with feeder wheel 210. Feeder wheel 210 may rotate around a first axis of rotation 212 and may be disposed such that first axis of rotation 212 is substantially vertical.

Feeder wheel 210 may be in operative communication with insertion wheel 220 at an interface locus 221. Insertion wheel 220 may rotate around a second axis of rotation 222 and may be disposed such that second axis of rotation 222 is substantially horizontal and substantially perpendicular to the direction of travel of the filter tow 120. Feeder wheel 210 and insertion wheel 220 may be synchronized such that the tangential speed of the circumferential edge of feeder wheel 210 may be substantially equal to the tangential speed of the circumferential edge of insertion wheel 220. In one embodiment, feeder wheel 210 and insertion wheel 220 may be synchronously driven by motor 208 via a gearbox 209. Motor 208 may be a servomotor or any other motive device known to one having ordinary skill in the art. Disposed below insertion wheel 220 may be a tow gathering funnel 216. Tow gathering funnel 216 may include a tow inlet aperture 217 and a tow outlet aperture 219. Tow gathering funnel 216 may also include a slit 218 defined in the upper surface of thereof, slit 218 being configured to receive the circumferential edge of insertion wheel 220.

Figure 3:
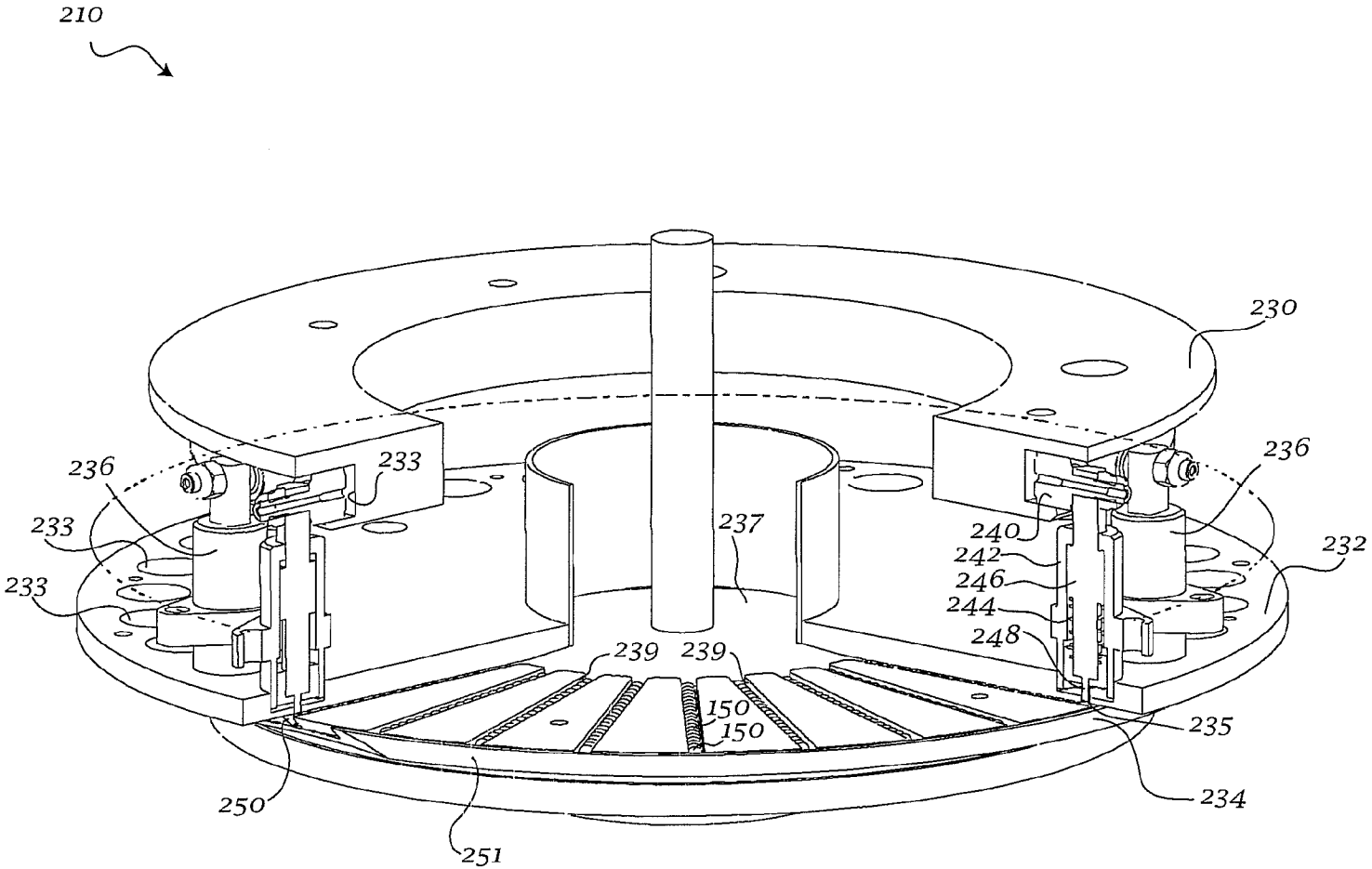
FIG. 3 is a view of an exemplary embodiment of a feeder wheel of a capsule insertion unit.

Turning to FIG. 3, feeder wheel 210 may include a stationary cam wheel 230, a cover portion 232, a bottom wheel 234 and a plurality of pins 236. Cam wheel 230 may have an annular groove 231 defined in the circumference thereof, and cover portion 232 may have a plurality of depressions 233 defined in the top surface thereof, each of depressions 233 corresponding to a pin 236. Each of pins 236 may include actuator 240, sleeve 242, spring 244, body 246, and tip 248. Spring 244 may be disposed between and engaged with body 246 and sleeve 242 such that tip 248 is withdrawn into sleeve 242 when pin 236 is not actuated. Each of pins 236 may be disposed between cam wheel 230 and cover portion 232, with actuator 240 being received in groove 231 of cam wheel 230 and body 246 being received within a corresponding depression 233 defined in cover portion 232. Each depression 233 may have a first aperture 235 defined in the center thereof, the first aperture 235 configured to receive tip 248 of pin 236.

The surface of annular groove 231 may undulate such that actuator 240 of a pin 236 may be engaged and depressed by the surface of annular groove 231 between certain points along annular groove 231. For example, the surface of annular groove 231 may be defined such that it does not engage actuators 240 of pins 236 when pins 236 are located above interface locus 221 between feeder wheel 210 and insertion wheel 220. The surface of annular groove 231 may further be defined such that it engages and depresses actuators 240 of pins 236 when pins 236 may not be in proximity to interface locus 221 between feeder wheel 210 and insertion wheel 220. When engaged and depressed by the surface of annular groove 231, actuator 240 may depress pin body 246 against the force of spring 244, causing tip 248 to penetrate downwards through and extend past first aperture 235 of a corresponding depression 233. Conversely, when actuator 240 is not depressed by the surface of annular groove 231, spring 244 may force pin body 246 upwards, thereby causing tip 248 to withdraw from first aperture 235.

Still referring to FIG. 3, bottom wheel 234 may have a central depression 237 defined in the center thereof, and a plurality of radial grooves 239 in communication with and extending from central depression 237 to the periphery of bottom wheel 234, such that each radial groove 239 terminates in a second aperture 250 at the circumferential edge 251 of bottom wheel 234. Each radial groove 239 may be sized to receive capsules 150 therein. Each of radial grooves 239 and second apertures 250 may correspond to a pin 236 and first aperture 235, while each first aperture 235 may be located near a peripheral end of a corresponding radial groove 239. Consequently, when a pin 236 is actuated as described above, tip 248 of pin 236 may pass through first aperture 235 and into a corresponding radial groove 239, thereby blocking communication between second aperture 250 and the remainder of radial groove 239. Capsules 150 in a radial groove 239 may thus have a reduced likelihood of accessing corresponding second aperture 250 when corresponding pin 236 is actuated.

Figures 4A, 4B, 4C:
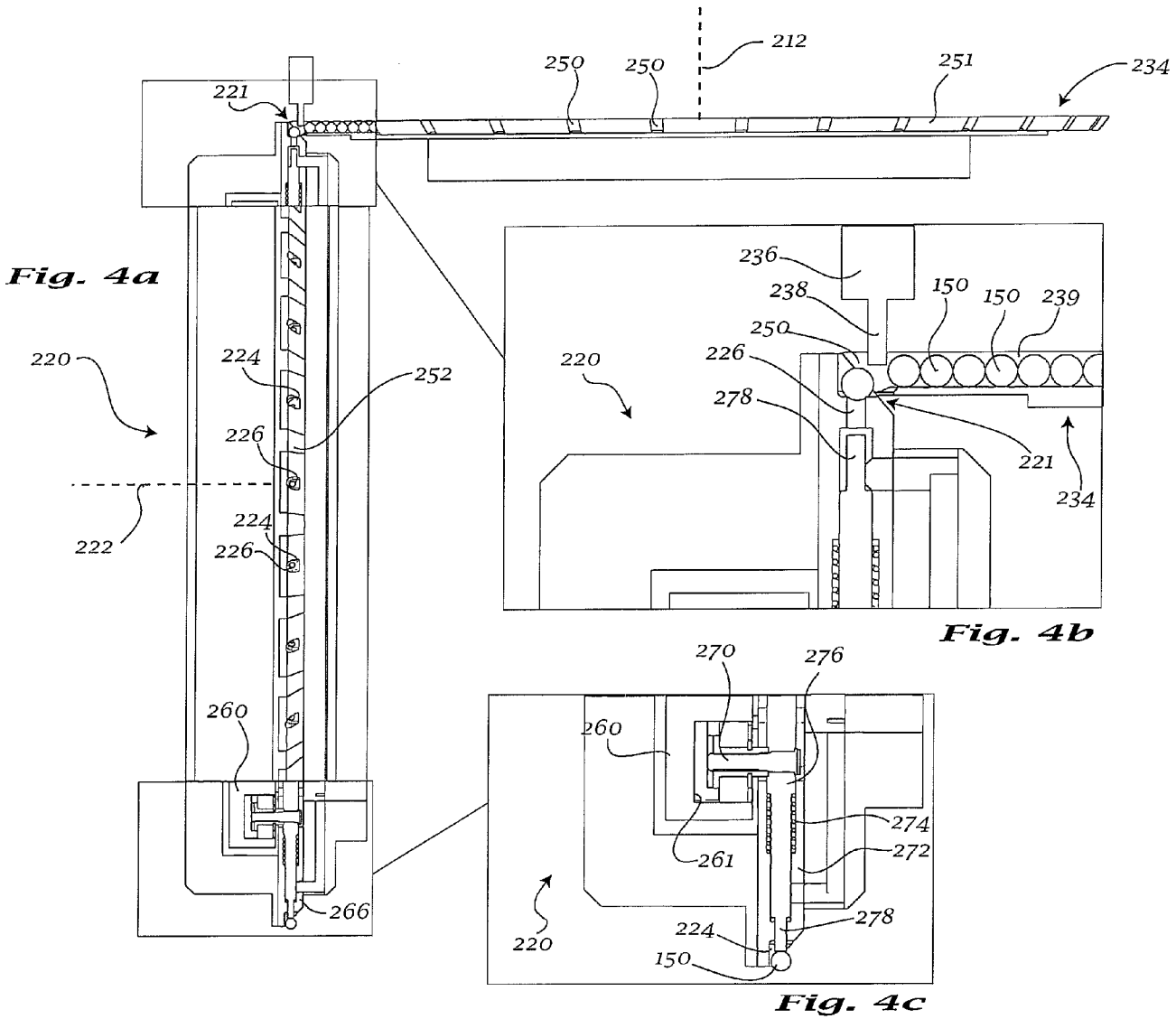
FIG. 4*a* is a diagram of an exemplary embodiment of a feeder wheel of a capsule insertion unit operatively coupled to an exemplary embodiment of an insertion wheel of a capsule insertion unit.
FIG. 4*b* is a detail of the interface locus between an exemplary embodiment of a feeder wheel and an exemplary embodiment of an insertion wheel.
FIG. 4*c* is a detail of the insertion locus of an exemplary embodiment of an insertion wheel.

Turning now to FIGS. 4*a*-4*c*, bottom wheel 234 of feeder wheel 210 may have a first circumferential edge 251, which may be defined at an angle to first axis of rotation 212 such that the diameter of the upper surface of bottom wheel 234 is greater than the diameter of the lower surface of bottom wheel 234. Similarly, insertion wheel 220 may have a second circumferential edge 252 defined at an angle such that at interface locus 221, first circumferential edge 251 of feeder wheel 210 and second circumferential edge 252 of feeder wheel 220 may be substantially parallel to and in contact with each other, as may be seen in FIG. 4*b*.

Insertion wheel 220 may include a plurality of recesses 224, each recess 224 configured to receive a capsule 150. Each recess 224 may have a third aperture 226 defined therein and a corresponding pin 266 disposed interior to and adjacent to each third aperture 226. Insertion wheel 220 may also include a stationary cam wheel 260, cam wheel 260 disposed within and being substantially coaxial to insertion wheel 220, and having a groove 261 defined therein.

Each of pins 266 may include actuator 270, sleeve 272, spring 274, body 276, and tip 278. Spring 274 may be disposed between and engaged with body 276 and sleeve 272 such that tip 278 is withdrawn into sleeve 272 when pin 266 is not actuated. The actuator 270 of each pin 266 may be received in groove 261 of cam wheel 260 while tip 278 of each pin 266 may be received within a corresponding third aperture 226. The surface of groove 261 may undulate such that actuator 270 of a pin 266 may be engaged and depressed by the surface of groove 261 between certain points along groove 261. For example, the surface of groove 261 may be defined such that it engages and depresses actuators 270 of pins 266 when pins 266 are located within slit 218 of tow not engage actuators 270 of pins 266 when pins 266 are not in proximity to slit 218 of tow gathering funnel 216. When engaged and depressed by the surface of groove 261, actuator 270 may depress pin body 276 against the force of spring 274, causing tip 278 to penetrate outward through and extend past third aperture 226 of a corresponding recess 224. Conversely, when actuator 270 is not depressed by the surface of groove 261, spring 274 may force pin body 276 inwards, thereby causing tip 278 to withdraw from third aperture 226.

Figure 5:
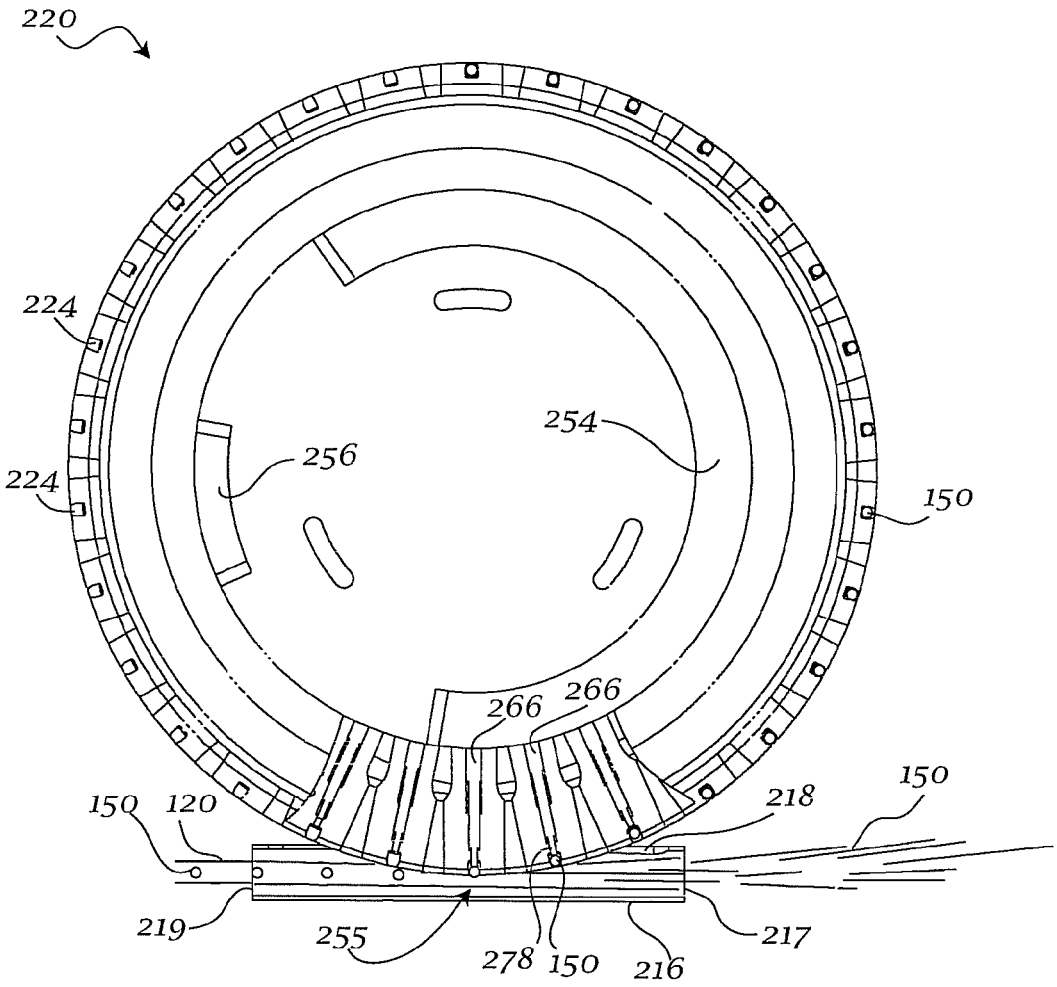
FIG. 5 is a view of an exemplary embodiment of an insertion wheel of a capsule insertion unit operatively engaged with a tow gathering funnel of a capsule insertion unit.

Turning to FIG. 5, insertion wheel 220 may be received in slit 218 of tow gathering funnel 216. Tow 120 may be drawn into tow gathering funnel 216 via tow inlet aperture 217. Within tow gathering funnel 216, tow 120 may be compacted such that tow 120 exits through tow outlet aperture 219 having a substantially rod-like shape. As tow 120 passes through tow gathering funnel 216, each of pins 266 may be actuated such that tip 278 of a pin 266 ejects capsule 150 from a recess 224 and inserts capsule 150 within tow 120. In one embodiment, the ejection and insertion operation may take place substantially near insertion locus 255. Consequently, when tow 120 exits through tow outlet aperture 219, capsules 150 are embedded at the desired regular intervals within tow 120.

Insertion wheel 120 may also have vacuum supplied to recesses 224 to facilitate maintaining capsules 150 within recesses 224. Vacuum may be applied when recesses 224 are located at certain positions relative to interface locus 221 and insertion locus 255. For example, insertion wheel 220 may include a suction zone 254, wherein vacuum is supplied to recesses traveling through suction zone 254. In one embodiment, suction zone 254 may begin prior to interface locus 221 and may end after or substantially near insertion locus 255, as shown in FIG. 5. Insertion wheel 120 may also have a cleaning zone 256, wherein positive air pressure may be supplied to recesses 224 when capsules 150 are not disposed within recesses 224, thereby facilitating cleaning of recesses 224 from any debris that may have accumulated during operation. In one embodiment, cleaning zone 256 may begin after insertion locus 255 and end prior to interface locus 221. It should be noted that terms such as "prior" and "after" as used in this paragraph should be understood as having reference to the direction of travel of recesses 224 relative to loci 221 and 255.

In operation, capsules 150 may be stored in hopper 202 and be withdrawn therefrom by belt 204, as shown in FIG. 2. Belt 204 may transfer capsules 150 from hopper 202 to inlet pipe 206. Capsules 150 are then deposited via inlet pipe 206 into central depression 237 of bottom wheel 234, as shown in FIG. 3. Bottom wheel 234 and cover portion 232 may be driven by motor 208 and rotate around first axis of rotation 212. As bottom wheel 234 and cover portion 232 rotate, capsules 150 may be driven into radial groves 239 by the centrifugal force generated from the rotation of bottom wheel 234 and cover portion 232. While a particular radial groove 239 is not in proximity to interface locus 221, tip 248 of a corresponding pin 236 may be disposed within radial groove 239, reducing the likelihood of capsules 150 exiting radial groove 239 via second aperture 250. As a particular radial groove 239 approaches interface locus 221, tip 248 of a corresponding pin 236 may withdraw from radial groove 239 and into corresponding first aperture 235, thereby allowing a capsule 150 to pass via second aperture 250 from radial groove 239 into a recess 224 of insertion wheel 220, as shown in FIG. 4*a* and FIG. 4*b*. As a radial groove 239 departs from interface locus 221, tip 248 of a corresponding pin 236 may reenter radial groove 239, thereby reducing the likelihood of remaining capsules 150 passing through second aperture 250.

As a capsule 150 passes from radial groove 239 of feeder wheel 210 to a recess 224 of insertion wheel 220, it should be noted that the velocity vector of capsule 150 may remain constant. Maintaining the velocity vector constant at interface locus 221 may facilitate high-speed transfer of capsules 150 from feeder wheel 210 to insertion wheel 220. Capsule 150 may also be drawn into and maintained within recess 224 by vacuum supplied to recess 224 while recess 224 is located within suction zone 254. Capsule 150 may then carried by insertion wheel 220 towards insertion locus 255. As a particular recess 224 approaches insertion locus 255, tip 278 of a corresponding pin 266 may enter recess 224 via third aperture 226, as shown in FIG. 4*a*, FIG. 4*c* and FIG. 5. Tip 278 may then displace capsule 150 within recess 224 while vacuum supply to recess 224 is withdrawn, thereby facilitating the insertion of capsule 150 into tow 120. Consequently, as tow 120 exits tow gathering funnel 216 in a substantially rod-like configuration, capsules 150 may then be disposed within tow 120 at predetermined, regular intervals.

Turning back to FIG. 1, filter tow 120 with capsules 150 disposed therein may then exit capsule insertion unit 200 and be directed to rod making unit 122. Tow 120 may then be deposited on garniture bed 124 wherein it may be formed into a continuous filter rod. The continuous filter rod may then be directed towards sensor 126 and knife carrier 128, where the continuous filter rod may be cut into individual filter portions by knives (not shown) within knife carrier 128. The individual filter portions may be evaluated by sensor 126 and filter portions that do not conform to desired specifications may be discarded.

The foregoing description and accompanying figures illustrate the principles, preferred embodiments and modes of operation of the invention. However, the invention should not be construed as being limited to the particular embodiments discussed above. Additional variations of the embodiments discussed above will be appreciated by those skilled in the art.

Therefore, the above-described embodiments should be regarded as illustrative rather than restrictive. Accordingly, it should be appreciated that variations to those embodiments can be made by those skilled in the art without departing from the scope of the invention as defined by the following claims.

What is claimed is:

1. An apparatus for insertion of capsules into cigarette filter tows, comprising:

a tow processing unit coupled to a capsule insertion unit and a filter rod making unit coupled to the capsule insertion unit, the tow processing unit further comprising a tow bale, a plurality of rollers, a plurality of banding jets and a plasticizer chamber;

the capsule insertion unit further comprising a hopper, an inlet pipe, a capsule feeder wheel rotating about a first axis of rotation, said feeder wheel further comprising an inner cavity in communication with said inlet pipe, a capsule insertion wheel in operative communication with said feeder wheel and rotating about a second axis of rotation, and a tow gathering funnel configured to receive an edge of said insertion wheel, wherein a circumferential edge of said capsule feeder wheel is parallel to a circumferential edge of said capsule insertion wheel at an interface locus between said capsule feeder wheel and said capsule insertion wheel, wherein said interface locus is at an oblique angle to said first axis of rotation and said second axis of rotation; and the rod making unit further comprising a garniture bed, a sensor and a knife carrier.

2. The apparatus of claim 1, wherein the capsule feeder wheel further comprises:

a plurality of radial grooves in communication with said inner cavity, each of said radial grooves configured to receive a plurality of capsules and terminating at an aperture at a circumferential edge of said feeder wheel;

a plurality of pins, each of said plurality of pins corresponding to each of said plurality of radial grooves, and disposed such that a tip of each of said plurality of pins is received within a corresponding radial groove; and a stationary cam wheel, said cam wheel configured to actuate said plurality of pins at desired points along the circumference of said cam wheel.

3. The apparatus of claim 1, wherein the capsule insertion wheel further comprises:

a plurality of recesses defined along a circumferential edge of said insertion wheel, each of said recesses configured to receive a capsule;

a plurality of pins, each of said plurality of pins corresponding to each of said plurality of recesses, and disposed such that a tip of each of said plurality of pins is received within a corresponding recess; and a stationary cam wheel, said cam wheel configured to actuate said plurality of pins at desired points along the circumference of said cam wheel.

4. The apparatus of claim 3, wherein said recesses are supplied with a vacuum.

5. The apparatus of claim 1, wherein said first axis of rotation and said second axis of rotation are orthogonal to each other.

6. The apparatus of claim 1, wherein said insertion wheel and said feeder wheel are configured to transfer said capsules such that the velocity vector of said capsules remains constant during transfer.

7. An apparatus for inserting capsules into filter tows, comprising:

a hopper, an inlet pipe, a capsule feeder wheel rotating about a first axis of rotation, said feeder wheel further comprising an inner cavity in communication with said inlet pipe, a plurality of radial grooves in communication with said inner cavity, each of said radial grooves configured to receive a plurality of capsules and terminating at an aperture at a circumferential edge of said feeder wheel, a capsule insertion wheel in operative communication with said feeder wheel and rotating about a second axis of rotation, said insertion wheel further comprising a plurality of recesses defined along a circumferential edge of said insertion wheel, each of said recesses configured to receive a capsule;

wherein said circumferential edge of said capsule feeder wheel is parallel to said circumferential edge of said capsule insertion wheel at an interface locus between said capsule feeder wheel and said capsule insertion wheel, wherein said interface locus is at an oblique angle to said first axis of rotation and said second axis of rotation; and a tow gathering funnel configured to receive a circumferential edge of said insertion wheel.

* * * * *